US008882102B2

(12) United States Patent
Nakachi

(10) Patent No.: US 8,882,102 B2
(45) Date of Patent: Nov. 11, 2014

(54) IMAGE FORMING APPARATUS

(71) Applicant: KYOCERA Document Solutions Inc., Osaka (JP)

(72) Inventor: Kazuhiro Nakachi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/226,718

(22) Filed: Mar. 26, 2014

(65) Prior Publication Data

US 2014/0291918 A1 Oct. 2, 2014

(30) Foreign Application Priority Data

Mar. 29, 2013 (JP) ..... 2013-071409

(51) Int. Cl.
*B65H 1/18* (2006.01)

(52) U.S. Cl.
CPC ..... *B65H 1/18* (2013.01)
USPC ..... 271/152; 271/153; 271/154; 271/155

(58) Field of Classification Search
USPC ..... 271/126, 127, 147, 152–155, 162
See application file for complete search history.

(56) References Cited

U.S. PATENT DOCUMENTS 4,503,960 A * 3/1985 Koeleman et al. ..... 192/127
5,971,392 A * 10/1999 Lee ..... 271/265.02
8,360,416 B2 * 1/2013 Hayama ..... 271/147

FOREIGN PATENT DOCUMENTS

JP 59053342 A * 3/1984 ..... B65H 7/04
JP 02310232 A * 12/1990 ..... B65H 7/04
JP 2000-335784 A 12/2000
JP 2006-039491 A 2/2006

* cited by examiner

*Primary Examiner* — Prasad Gokhale
(74) *Attorney, Agent, or Firm* — Knobbe, Martens, Olson & Bear LLP

(57) ABSTRACT

A multifunction peripheral includes: a moving device configured to move up a lift plate; a changing device configured to mechanically change a resistance value of a variable resistor depending upon a position of the lift plate; a mechanical switch; a connecting device configured to apply a predetermined DC voltage to the variable resistor when an upper end of one or more paper sheets placed on the lift plate or an upper end of the lift plate has reached a predetermined uppermost position in the paper feed cassette; a calculating device configured to calculate a remaining amount of paper sheets placed on the lift plate as a function of a DC voltage value output from the variable resistor; and a stopping device configured to stop upward movement of the lift plate using the DC voltage value output from the variable resistor.

6 Claims, 8 Drawing Sheets

IMAGE FORMING APPARATUS

INCORPORATION BY REFERENCE

This application claims priority to Japanese Patent Application No. 2013-071409 filed on Mar. 29, 2013, the entire contents of which are incorporated by reference herein.

BACKGROUND

The present disclosure relates to image forming apparatuses and particularly relates to an image forming apparatus which can calculate the remaining amount of paper sheets through a single analog input port and can control the movement of a lift plate in a paper feed cassette on the part of the paper feed cassette.

Various types of detection in an image forming apparatus, such as a printer, are increasingly performed by digital processing. For example, the detection of the remaining amount of paper sheets is conventionally performed by four-stage digital processing using at least two sensors. For this purpose, at least two digital input ports are provided in the image forming apparatus.

A digital input port is necessary for each sensor. Therefore, with increasing number of parameters to be processed because of added functions, the required number of ports also increases. In addition, when the number of ports increases, the cost for the CPU of the image forming apparatus accordingly increases. Therefore, there is a challenge in that high functionality needs to be achieved while the required number of ports is reduced as much as possible.

An image output device is known which, to address the above challenge, includes a paper cassette capable of storing recording paper sheets, a movable part movable according to the remaining amount of recording paper sheets in the paper cassette, and a remaining paper amount detecting section configured to detect the remaining amount of paper sheets in the paper cassette by detecting the position of the movable part. In this case, the detection of the remaining amount can be displayed in multiple steps using a single analog input port. Thus, an image output device can be provided which can detect the remaining amount of paper sheets with a simple structure or can continuously detect the remaining amount of paper sheets with a simple structure.

Alternatively, an image forming apparatus is known in which units internally equipped with a short circuit can be installed into the apparatus body. The image forming apparatus includes: a first body-side connecting part operable to, upon installation of one or more units into the apparatus body, connect one or more separate resistive elements provided inside the apparatus body, one separate resistive element for each unit, to their respective associated short circuits and apply voltage to the separate resistive elements; and a second body-side connecting part operable to, upon selective installation of at least two units into the apparatus body, connect a common resistive element, which is provided inside the apparatus body and can be shared among the at least two units, to the short circuit of the installed one of the at least two units and apply voltage to the common resistive element. The image forming apparatus further includes an installation status determining section configured to, based on the voltage applied to the separate resistive elements and/or the common resistive element owing to the installation of the unit or units, the status of installation of the unit or units installed in the apparatus body with some exceptions. Thus, as for the units selectively installed, there is no need to provide their individual resistive elements. As a result, the number of resistive elements used can be reduced, resulting in cost reduction of the image forming apparatus. Furthermore, the voltage applied to the separate resistive elements and/or the common resistive element is detected through a single detection port. Therefore, the number of signal lines and detection ports for use in detecting whether or not each of optional units, a developing unit, a photoconductor unit, and so on is installed can be reduced, resulting in line saving and cost reduction.

SUMMARY

A technique improved over the aforementioned techniques is proposed as one aspect of the present disclosure.

An image forming apparatus according to one aspect of the present disclosure includes a paper feed cassette with a lift plate, a moving device, a changing device, a mechanical switch, a connecting device, a calculating device, and a stopping device. The moving device is configured to move up the lift plate with an associated motor. The changing device is configured to mechanically change a resistance value of a variable resistor depending upon a position of the lift plate. The mechanical switch is configured to mechanically detect that an upper end of one or more paper sheets placed on the lift plate or an upper end of the lift plate has reached a predetermined uppermost position in the paper feed cassette. The connecting device is configured to apply a predetermined DC voltage to the variable resistor when the upper end of the one or more paper sheets placed on the lift plate or the upper end of the lift plate has reached the predetermined uppermost position in the paper feed cassette. The calculating device is configured to calculate a remaining amount of paper sheets placed on the lift plate as a function of a DC voltage value output from the variable resistor. The stopping device is configured to stop upward movement of the lift plate using the DC voltage value output from the variable resistor.

DETAILED DESCRIPTION

Hereinafter, a description will be given of an embodiment of an image forming apparatus according to the present disclosure with reference to the accompanying drawings to provide an understanding of the present disclosure. The following embodiment is simply a specific example of the present disclosure and not intended to limit the technical scope of the present disclosure. The alphabetical character S affixed before each numeral in the flowchart means "step".

<Image Forming Apparatus>

Figure 1:
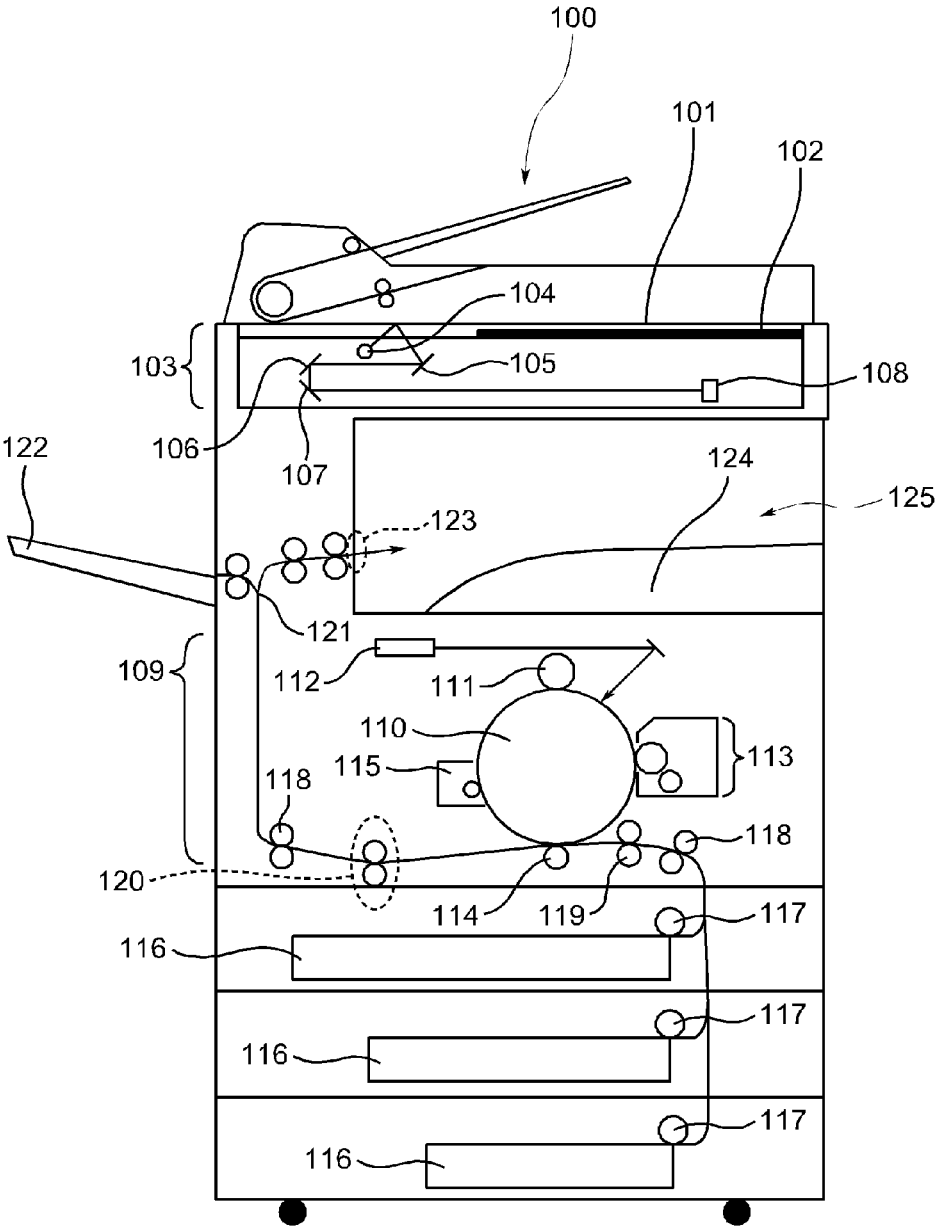
FIG. 1 is a conceptual view showing a general internal structure of a multifunction peripheral according to one embodiment of the present disclosure.

A description will be given below of an image forming apparatus according to an embodiment of the present disclosure. FIG. 1 is a schematic view of the image forming apparatus according to this embodiment of the present disclosure. Details of elements not directly relevant to the present disclosure are not shown in the figure.

The image forming apparatus according to the present disclosure corresponds to, for example, a printer or a multifunction peripheral including a printer, a copier, a scanner, a facsimile machine, and so on and the multifunction peripheral functions as an image forming apparatus having multiple functions including, for example, a copy function, a scan function, a facsimile function, and a print function.

By way of example, a brief description will be given below of the operation of a multifunction peripheral (MFP) 100 when the user uses the copy function.

In using the multifunction peripheral 100, the user first places an original document on an original glass plate (document table) 101 provided on the top surface of a housing of the multifunction peripheral 100. Subsequently, the user uses an operating section (operating panel) 102 provided near the original glass plate 101 to input settings relating to image formation through an operating screen of the operating section 102. Then, when the user pushes down a Start key provided on the operating section 102, the multifunction peripheral 100 starts image formation (print processing).

Next, in an image reading section 103, light emitted from a light source 104 is reflected on the original document placed on the original glass plate 101. The reflected light is guided to an image pickup device 108 by mirrors 105, 106, and 107. The guided light is converted into electricity by the image pickup device 108, so that image data corresponding to the original document is generated.

An image forming section 109 is a section configured to form a toner image based on the image data. The image forming section 109 includes a photosensitive drum 110. The photosensitive drum 110 is rotatable at a constant speed in a predetermined direction. Disposed around the photosensitive drum 110 are a charger 111, an exposure unit 112, a developer 113, a transferor 114, and a cleaning unit 115 in order from upstream to downstream in the direction of rotation.

The charger 111 is configured to uniformly charge the surface of the photosensitive drum 110. The exposure unit 112 is configured to irradiate the charged surface of the photosensitive drum 110 with laser light based on the image data to form an electrostatic latent image. The developer 114 is configured to deposit toner on the formed electrostatic latent image to form a toner image. The formed toner image is transferred to a recording medium (for example, a paper sheet or a sheet) by the transferor 114. The cleaning unit 115 is configured to remove extra toner remaining on the surface of the photosensitive drum 110. This series of processes is executed with rotation of the photosensitive drum 110.

A paper sheet can be conveyed from any one of a plurality of paper feed cassettes 116 included in the multifunction peripheral 100. In conveying a paper sheet, the paper sheet is picked up from one of the paper feed cassettes 116 to a conveyance path by a paper feed roller (pick-up roller) 117. The different paper feed cassettes 116 contain different types of paper sheets and are configured to feed (convey) a paper sheet of the type selected based on the settings relating to image formation.

The paper sheet picked up to the conveyance path is introduced between the photosensitive drum 110 and the transferor 114 by a conveyance roller 118 and a registration roller 119. When the paper sheet is introduced therebetween, the transferor 114 transfers the toner image to the paper sheet and the paper sheet with the toner image transferred is then conveyed to a fixing device 120.

When the paper sheet with the toner image transferred thereto passes through between a heat roller and a pressure roller both provided in the fixing device 120, heat and pressure are applied to the toner image, so that a visible image is fixed on the paper sheet. The amount of heat of the heat roller is optimally set according to the paper type for suitable fixing. The image formation ends with the fixing of the visible image on the paper sheet. Thereafter, the paper sheet is guided to a path switching section 121 by the conveyance roller 118.

In the path switching section 121, based on a command from the multifunction peripheral 100 to switch the path, the paper sheet is guided to a paper output tray 122 provided at a side surface of the housing or guided through a paper output port 123 to an intra-body tray 124 provided inside the housing. The output paper sheets are piled up and held on the paper output tray 122 or the intra-body tray 124. In the above manner, the housing 125 of the multifunction peripheral 100 offers an image forming function to the user.

Figure 2:
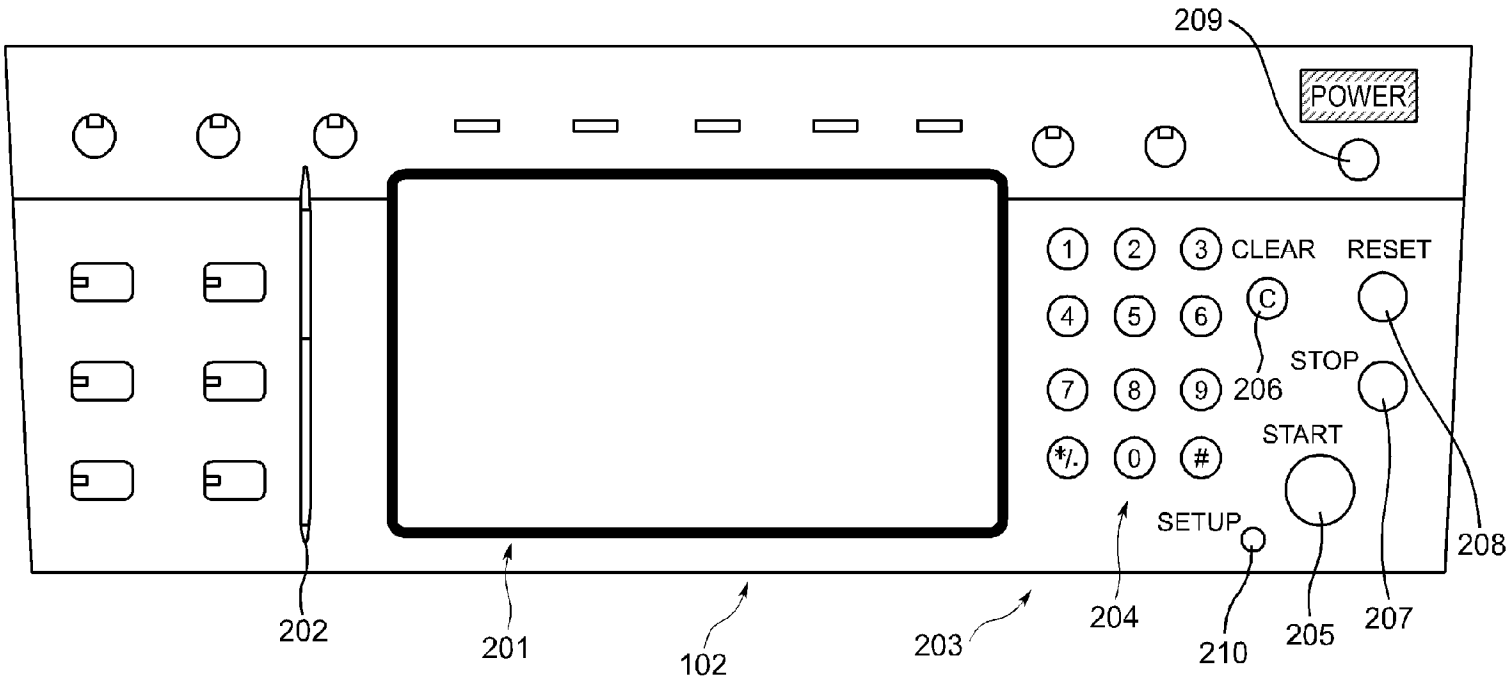
FIG. 2 is a conceptual view showing a general structure of an operating section in the one embodiment of the present disclosure.

FIG. 2 is a conceptual view showing a general structure of the operating section in this embodiment of the present disclosure. The user uses the operating section 102 to input such settings relating to image formation as described above or check the input settings. In inputting settings, the touch panel (operating panel) 201, a touch pen 202, and/or operating keys 203, all of which are provided in the operating section 102, are used.

The touch panel 201 combines the function of inputting settings and the function of displaying the settings. Specifically, with a push of any key in the screen displayed on the touch panel 201, a setting corresponding to the pushed key is input.

The back side of the touch panel 201 is provided with a display formed such as of an LCD (liquid crystal display). The display displays the operating screen, such as an initial screen. The touch pen 202 is placed near the touch panel 201. When the user touches the tip of the touch pen 202 to the touch panel 201, a sensor provided under the touch panel 201 detects the touch point.

A predetermined number of operating keys 203 are also provided near the touch panel 201, such as, for example, a ten-key pad 204, a Start key 205, a Clear key 206, a Stop key 207, a Reset key 208, and a Power key 209.

Figure 3:
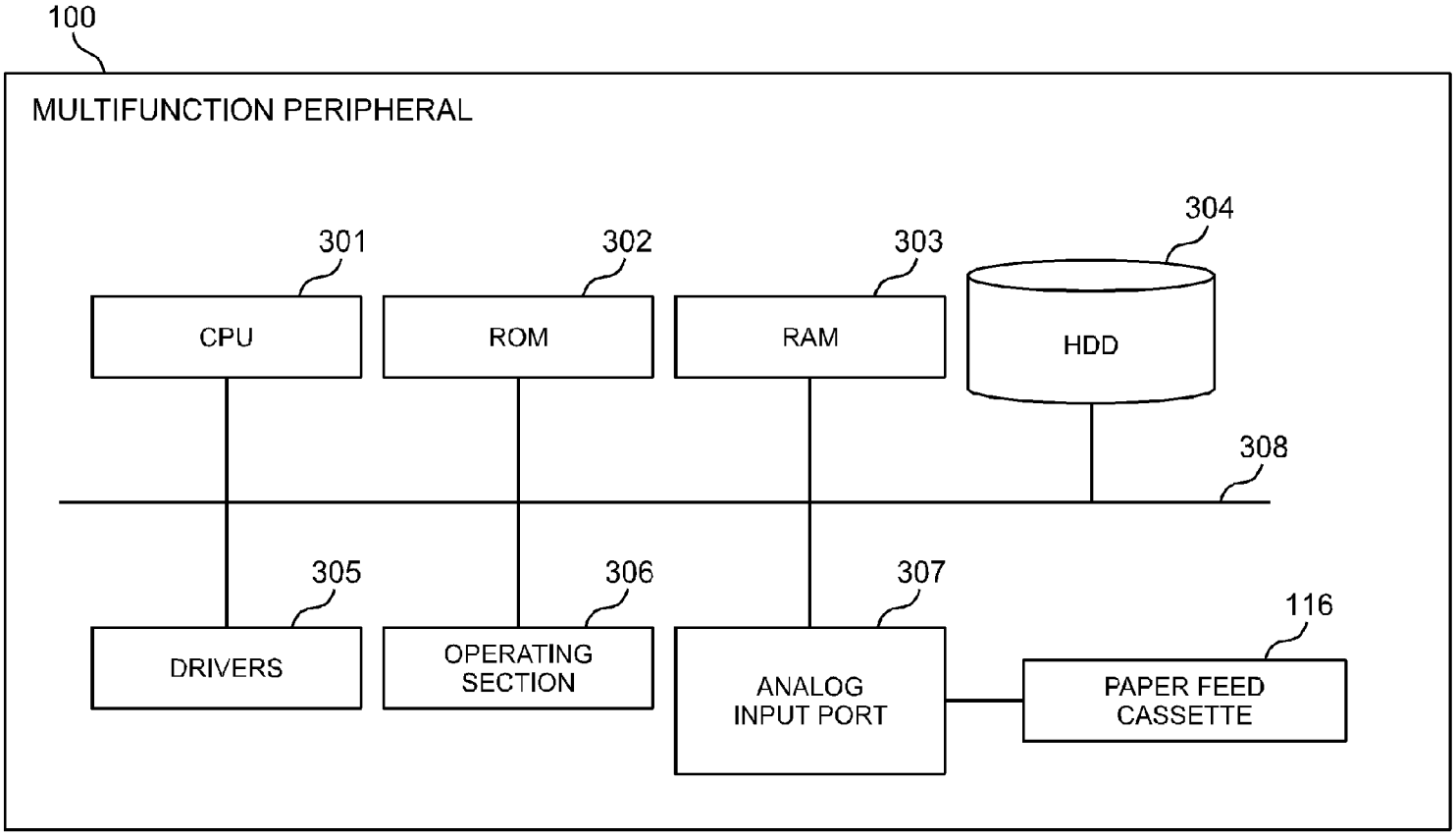
FIG. 3 is a diagram showing a hardware configuration of a control system of the multifunction peripheral according to the one embodiment of the present disclosure.

Next, with reference to FIG. 3, a description will be given of a hardware configuration of a control system of the multifunction peripheral 100. FIG. 3 is a diagram showing a hardware configuration of a control system of the multifunction peripheral 100 according to the present disclosure. Details of elements not directly relevant to the present disclosure are not shown in the figure.

In a control circuit of the multifunction peripheral 100, a CPU (central processing unit) 301, a ROM (read only memory) 302, a RAM (random access memory) 303, an HDD (hard disk drive) 304, drivers 305 associated with their respective drive parts, the operating section 306 (102), an analog input port 307 are electrically connected to each other via an internal bus 308.

The CPU 301 uses, for example, the RAM 303 as a working region to execute programs stored in the ROM 302, the HDD 304, and so on, communicates, based on the program execution results, data, commands, signals corresponding to the keys, instructions, and the like from the operating section 306 with the drivers 305, and controls the individual operations of the drive parts shown in FIG. 1.

Furthermore, the CPU 301 receives a predetermined DC voltage value from a paper feed cassette 116 through the analog input port 307, calculates the remaining amount of paper sheets in the paper feed cassette as a function of the magnitude of the DC voltage value, and allows the operating section 306 to display the remaining amount of paper sheets.

Also for the after-mentioned devices (shown in FIG. 4) other than the drive parts, the CPU 301 achieves the implementation of the devices by executing their associated programs. The ROM 302, the HDD 304, and so on store the programs and data for achieving the implementation of the devices to be described later.

<Embodiment of Present Disclosure>

Figure 4:
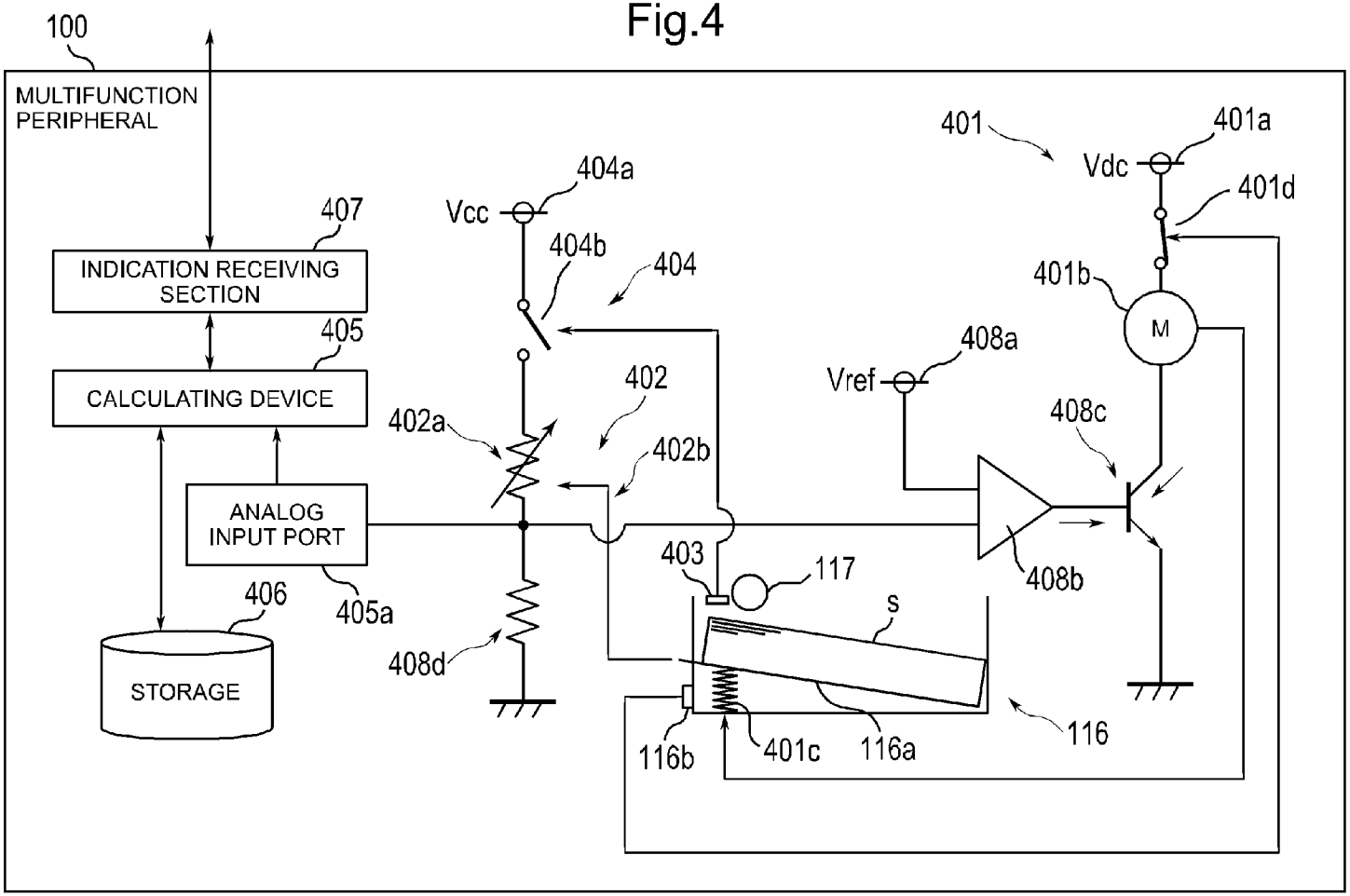
FIG. 4 is a functional block diagram of the multifunction peripheral according to the one embodiment of the present disclosure.
Figure 5:
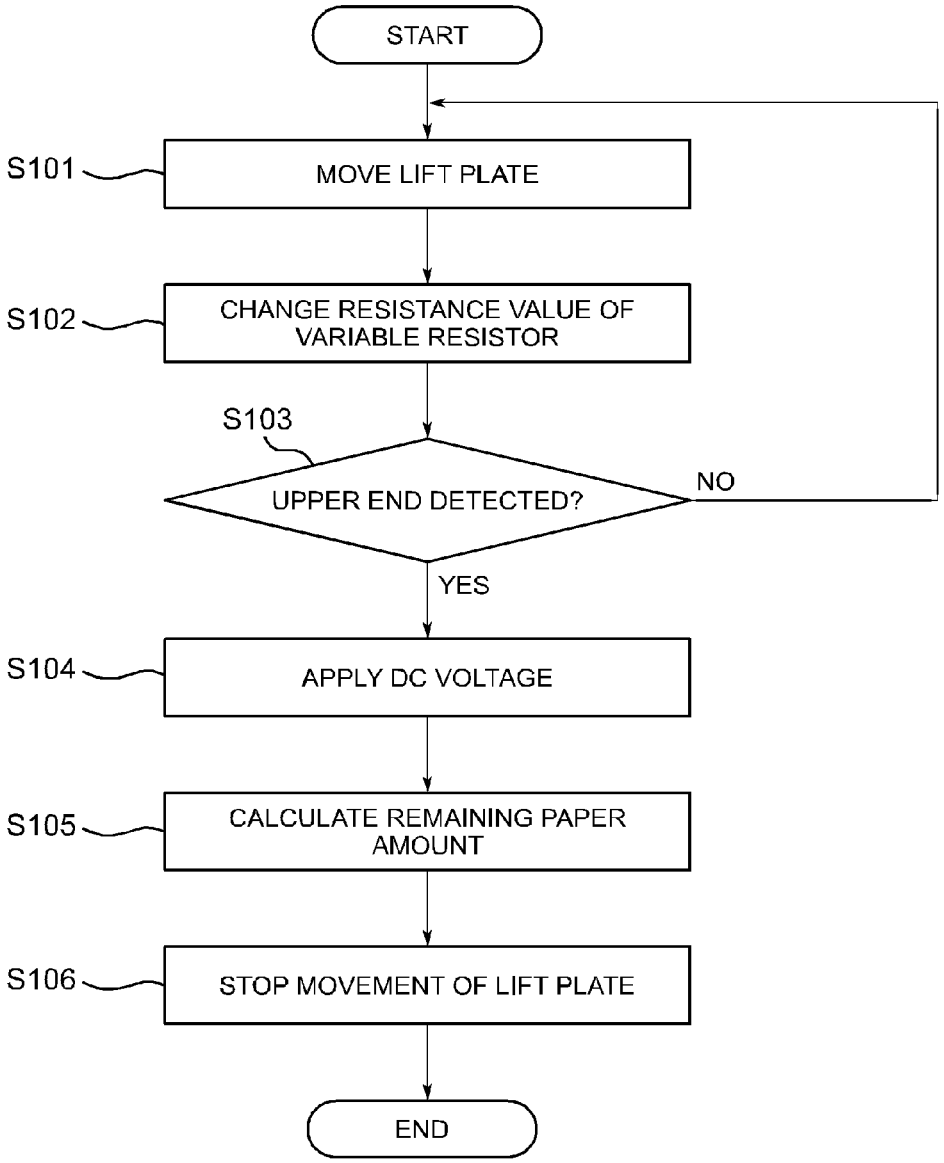
FIG. 5 is a flowchart for illustrating an execution procedure in the one embodiment of the present disclosure.

Next, a description will be given of a configuration and execution procedure relevant to the embodiment of the present disclosure with reference to FIGS. 4 and 5. FIG. 4 is a functional block diagram of the multifunction peripheral according to the embodiment of the present disclosure. FIG. 5 is a flowchart for illustrating an execution procedure in the embodiment of the present disclosure.

First, when the user pulls a given paper feed cassette 116 out of the multifunction peripheral 100, places a predetermined amount of paper sheets S on the lift plate 116*a* movably disposed on the bottom surface of the paper feed cassette 116, and then installs the paper feed cassette 116 back into the multifunction peripheral 100, an opening/closing detection sensor 116*b* provided at the back surface of the paper feed cassette 116, as shown in FIG. 4, detects the installation of the paper feed cassette 116 and notifies a moving device 401 of it. The moving device 401 having received the notification moves up the lift plate 116*a* with an associated motor 401*b* (S101 in FIG. 5).

Although no particular limitation is placed on how the moving device 401 moves up the lift plate 116*a*, it is implemented, for example, in the following manner. Firstly, the moving device 401 includes: a first direct current source 401*a* capable of applying a predetermined DC voltage Vdc (V); a motor 401*b* electrically connected to the first direct current source 401*a* and rotatable in a predetermined direction by application of the DC voltage Vdc; an elastic member 401*c*, such as a spring, mechanically connected to the motor 401*b*, provided at a lower end (underside) of an end portion of the lift plate 116*a* close to the conveyance path, and upwardly extendable by the rotation of the motor 401*b* in the predetermined direction; and a first switch 401*d* operable to make or break an electrical connection between the first direct current source 401*a* and the motor 401*b*. Secondly, the first switch 401*d* is configured to break the electrical connection in the absence of detection of the opening/closing detection sensor 116*b* and make the electrical connection with the detection of the opening/closing detection sensor 116*b*.

With the above configuration, the control over the motor 401*b* can be implemented without the use of the control circuit, such as the CPU. In this embodiment, the first switch 401*b* breaks the electrical connection when the opening/closing detection sensor 116*b* detects that the paper feed cassette 116 has been pulled out.

When the moving device 401 moves up the lift plate 116*a*, the changing device 402 mechanically changes the resistance value Rvr (Ω) of a variable resistor (VR) 402*a* depending upon the position of the lift plate 116*a* (S102 in FIG. 5).

Although no particular limitation is placed on how the changing device 402 mechanically changes the resistance value of the variable resistor 402*a* depending upon the position of the lift plate 116*a*, it is implemented, for example, in the following manner. The changing device 402 includes a connecting member 402*b* which is mechanically connected at one end to an end of the lift plate 116*a* close to the conveyance path, mechanically connected at the other end to a variable portion (variable knob) of the variable resistor 402*a*, and configured to continuously move the variable portion in conjunction with the amount of movement of the lift plate 116*a*.

With the above configuration, when the lift plate 116*a* moves up, the variable portion of the variable resistor 402*a* is moved through the connecting member 402*b*, so that the resistance value Rvr (Ω) of the variable resistor 402*a* can be changed. In this embodiment, for example, the changing device 402 shown in FIG. 4 is configured so that as the lift plate 11*a* moves up, the resistance value Rvr (Ω) of the variable resistor 402*a* becomes lower.

Near the paper feed roller 117 located above the paper feed cassette 116, a mechanical switch 403 is previously provided. The mechanical switch 403 is configured to mechanically detect that the upper end of one or more paper sheets S placed on the lift plate 116*a* or the upper end of the lift plate 116*a* has reached a predetermined uppermost position in the paper feed cassette 116. The mechanical switch 403 is formed of, for example, a tactile switch or a switch with a transistor based on PI control. The predetermined position is, for example, a position where upon rotation of the paper feed roller 117 at the time when the upper end of the uppermost paper sheet S reaches the position, the uppermost paper sheet S can be conveyed therefrom. Furthermore, for example, the mechanical switch 403 is configured to output an OFF signal with no contact with any object and output an ON signal upon contact with the upper end of paper sheets S placed on the lift plate 116*a* or the upper end of the lift plate 116*a*.

With the above configuration, a sensor for detecting the upper end of the lift plate 116*a* and one digital input port for inputting the ON/OFF signal of the sensor to the control circuit, such as the CPU, which would be provided in a general image forming apparatus, can be dispensed with.

The mechanical switch 403 detects whether or not the upper end has reached the predetermined uppermost position in the paper feed cassette 116 (S103 in FIG. 5).

If, as a result of the detection, the upper end has not reached the predetermined uppermost position in the paper feed cassette 116 (NO in S103 in FIG. 5), that is, when the mechanical switch 403 remains OFF, the procedure returns to S101 to move up the lift plate 116*a* (S101 in FIG. 5) and the resistance value Rvr (Ω) of the variable resistor 402*a* is changed (S102 in FIG. 5).

Figure 6:
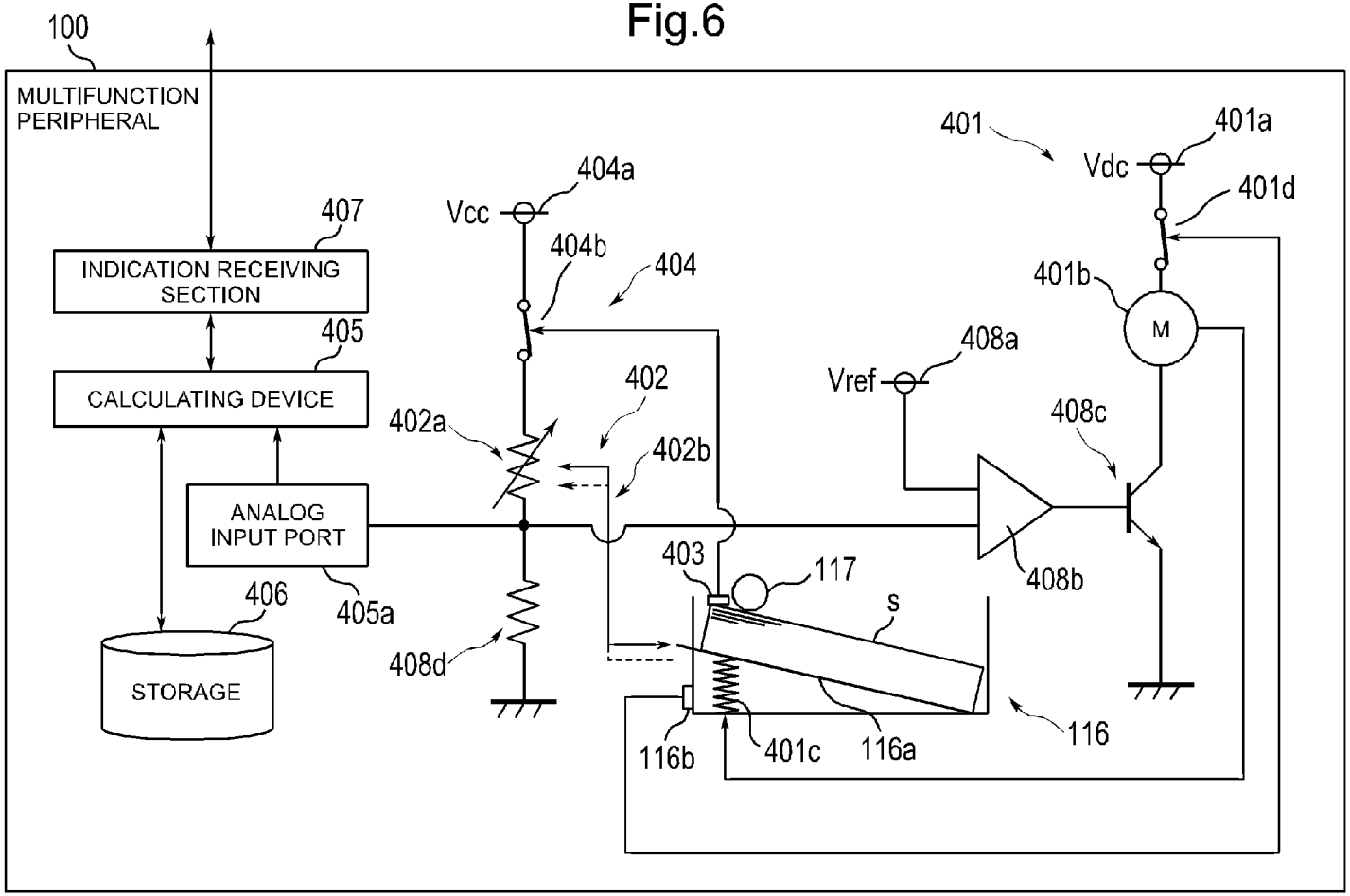
FIG. 6 is a functional block diagram of the multifunction peripheral according to the one embodiment of the present disclosure when a lift plate has moved up.

On the other hand, as shown in FIG. 6, if, as a result of the detection, the upper end has reached the predetermined uppermost position in the paper feed cassette 116 (YES in S103 in FIG. 5), that is, when the mechanical switch 403 is turned ON, the mechanical switch 403 notifies the connecting device 404 of it and the connecting device 404 having received the notification applies a predetermined DC voltage Vcc (V) to the variable resistor 402*a* (S104 in FIG. 5).

Although no particular limitation is placed on how the connecting device 404 applies the DC voltage Vcc (V) to the variable resistor 402*a*, it is implemented, for example, in the following manner. Firstly, the connecting device 404 includes: a second direct current source 404*a* capable of applying a predetermined DC voltage Vcc (V); and a second switch 404*b* configured to make or break an electrical connection between the second direct current source 404*a* and the variable resistor 402*a*. Secondly, the second switch 404*b* is configured to break the electrical connection upon receipt of an OFF signal from the mechanical switch 403 and make the electrical connection upon receipt of an ON signal from the mechanical switch 403.

With the above configuration, the electrical connection can be implemented without the use of the control circuit, such as the CPU.

When the predetermined DC voltage Vcc (V) is applied to the variable resistor 402*a*, a DC voltage value Vvr (V) according to the resistance value Rvr (Ω) of the variable resistor 402*a* is output. In this case, the resistance value Rvr (Ω) of the variable resistor 402*a* depends upon the position of the lift plate 116*a*. Therefore, by analyzing the DC voltage value Vvr (V) according to the resistance value Rvr (Ω), the position of the lift plate 116*a*, i.e., the remaining amount of paper sheets placed on the lift plate 116*a*, can be analyzed.

For this purpose, when the predetermined DC voltage Vcc (V) is applied to the variable resistor 402*a*, a calculating device 405 calculates the remaining amount of paper sheets placed on the lift plate 116*a* as a function of the DC voltage value Vvr (V) output from the variable resistor 402*a* (S105 in FIG. 5).

Although no particular limitation is placed on how the calculating device 405 calculates the remaining amount (%) of paper sheets placed on the lift plate 116*a*, it is implemented, for example, in the following manner. Firstly, the calculating device 405 includes an analog input port 405*a* (307) through which it receives the DC voltage value Vvr (V) output from the variable resistor 402*a* and which converts the DC voltage value Vvr (V) output by the variable resistor 402*a* from analog to digital. Secondly, the calculating device 405 acquires the DC voltage value Vvr (V) output from (digitalized by) the analog input port 405*a* and refers to a table stored in a storage 406.

Figure 7:
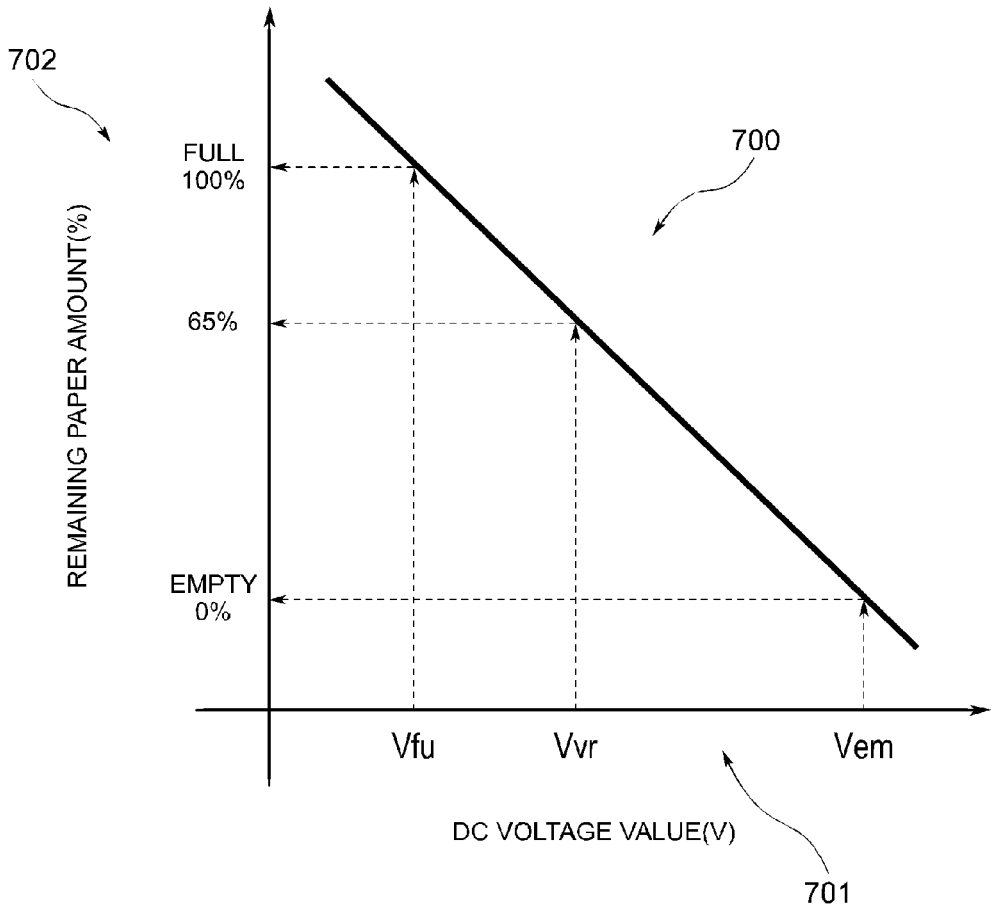
FIG. 7 is a graph showing an example of a table in the one embodiment of the present disclosure.

As shown in FIG. 7, the table 700 contains (digitalized) DC voltage values 701 (V) output from the variable resistor 402*a* and remaining amounts 702 (%) of paper sheets placed on the lift plate 116*a* in association with each other so that the remaining amount 702 of paper sheets decreases with increasing DC voltage value 701. The decrease in the remaining amount 702 of paper sheets corresponds to the decrease in the resistance value Rvr (Ω) of the variable resistor 402*a*, i.e., the rise in the position of the lift plate 116*a*. Specifically, the maximum DC voltage value Vem (V) to be output at the minimum resistance value Rvr (Ω) of the variable resistor 402*a* is associated with that the remaining amount (%) of paper sheets is 0% and the minimum DC voltage value Vfu (V) to be output at the maximum resistance value Rvr (Ω) of the variable resistor 402*a* is associated with that the remaining amount (%) of paper sheets is 100%.

The calculating device 405 acquires, from the table 700, the remaining amount 702 (%) of paper sheets associated with the DC voltage value 701 (V) corresponding to the acquired DC voltage value Vvr (V) (for example, "65%") and outputs it as a calculated remaining amount 702 (%) of paper sheets. Thus, instead of detecting the remaining amount of paper sheets using two digital input ports in a general image forming apparatus, the remaining amount 702 (%) of paper sheets can be calculated as a multistep continuous value through a single analog input port 405*a*.

When the calculating device 405 calculates the remaining amount 702 (%) of paper sheets, an indication receiving section 407, for example, is notified of the remaining amount 702. The indication receiving section 407 having received the notification allows the touch panel 201 of the operating section 102 to display a print screen (initial screen) including the remaining amount 702 (%) of paper sheets.

Figure 8:
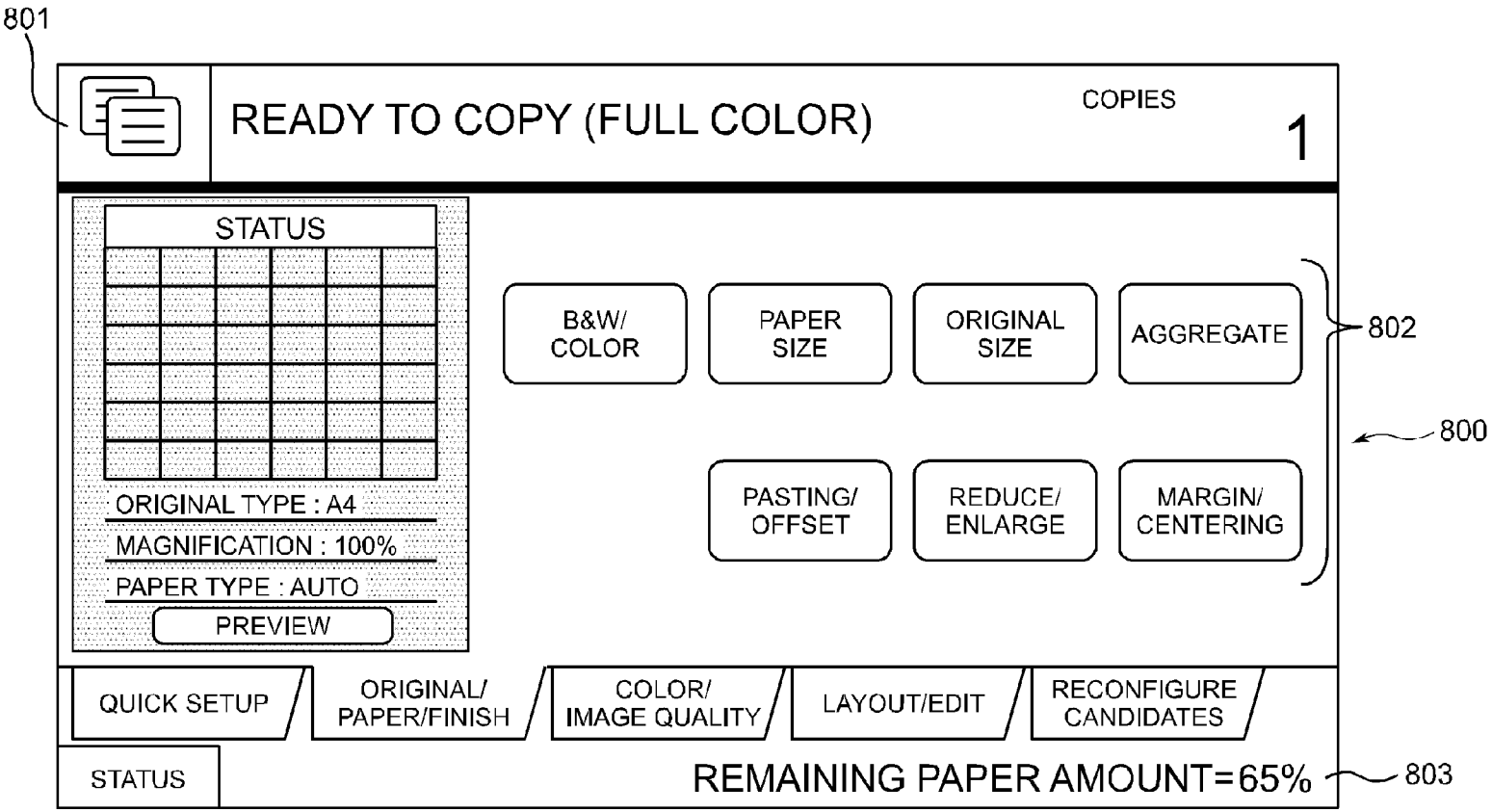
FIG. 8 is a view showing an example of a print screen displayed on a touch panel in the one embodiment of the present disclosure.

As shown in FIG. 8, displayed on the print screen 800 are a message 801 prompting to input print settings, setting items 802 for use in inputting print settings (for example, "B&W/Color", "Reduce/Enlarge", and so on), and the remaining amount 803 (%) of paper sheets ("65%"). Thus, the user can be notified of a multistep remaining amount of paper sheets.

Meanwhile, using the DC voltage value Vvr (V) output from the variable resistor 402*a*, a stopping device 408 stops the upward movement of the lift plate 116*a* (S106 in FIG. 5).

Although no particular limitation is placed on how the stopping device 408 stops the upward movement of the lift plate 116*a*, it is implemented, for example, in the following manner. Firstly, the stopping device 408 includes: a third direct current source 408*a* capable of applying a higher DC voltage Vref (V) than the DC voltage Vcc (V) of the second direct current source 404*a*; and a comparator 408*b* configured to compare the DC voltage Vref (V) of the third direct current source 408*a* with the DC voltage value Vvr (V) output from the variable resistor 402*a* and output a predetermined DV voltage value (an ON signal) when the DV voltage value Vvr (V) is 0 V (the comparison value is Vref (V) only) or provide no output (an OFF signal) when the DC voltage value Vvr (V) is higher than 0 V (the comparison value is other than Vref (V)). The stopping device 408 further includes a transistor 408*c* which is a switching element configured to allow electrical continuity of the moving device 401 with the motor 401*b* upon receipt of the predetermined DC voltage value output from the comparator 408*b* and forbid electrical continuity of the moving device 401 with the motor 401*b* in the absence of output from the comparator 408*b*.

With the above configuration, the rotation of the motor 401*b* can be stopped without the need for any signal from the CPU of the multifunction peripheral 100. Therefore, one digital output port for controlling the rotation of the motor 401*b*, which would be provided in a general image forming apparatus, can be dispensed with. Furthermore, all of signals to the control circuit, such as the CPU, can be covered by a single analog input port 405*a* and the upward movement of the lift plate 116*a* in the paper feed cassette 116 need not be controlled on the part of the multifunction peripheral 100. Therefore, it can be implemented to independently control the movement of the lift plate 116*a* on the part of the paper feed cassette 116. Thus, for example, the paper feed cassette 116 can be diverted to or exchanged among different types of multifunction peripherals.

The transistor 408*c* is electrically connected at the base terminal to the output terminal of the comparator 408*b*, electrically connected at the collector terminal to a terminal of the motor 401*b* opposite to the first direct current source 401*a*, and electrically connected at the emitter terminal to a ground terminal serving as a reference potential point. Furthermore, a terminal of the variable resistor 402*a* opposite to the second direct current source 404*a* is electrically connected, through a fixed resistor 408*d* with a predetermined resistance value R (Ω), to a ground terminal and configured so that when the second switch 404*b* is closed, the DC voltage value Vvr (V) of the variable resistor 402*a* is output (applied) to the analog input port 405*a* and the comparator 408*b*. Thus, the switching function of the transistor 408*c* can be certainly fulfilled.

A general image forming apparatus has a problem in that one port is given a single function and cannot be given a plurality of functions. The image forming apparatus according to the one aspect of the present disclosure has been devised with the foregoing in mind and an object of the present disclosure is to provide an image forming apparatus which can calculate the remaining amount of paper sheets through a single analog input port and can control the movement of a lift plate in a paper feed cassette on the part of the paper feed cassette.

The image forming apparatus according to the one aspect of the present disclosure includes: the moving device 401 configured to move up the lift plate 116*a*; the changing device 402 configured to mechanically change the resistance value Rvr (Ω) of the variable resistor 402*a* depending upon the position of the lift plate 116*a*; and the mechanical switch 403 configured to mechanically detect that the upper end of one or more paper sheets placed on the lift plate 116*a* or the upper end of the lift plate 116*a* has reached a predetermined uppermost position in the paper feed cassette 116. Furthermore, the image forming apparatus according to the one aspect of the present disclosure includes the connecting device 404 configured to apply a predetermined DC voltage to the variable resistor 402*a* when the upper end of the one or more paper sheets placed on the lift plate 116*a* or the upper end of the lift plate 116*a* has reached the predetermined uppermost position in the paper feed cassette 116; the calculating device 405 configured to calculate the remaining amount of paper sheets placed on the lift plate 116*a* as a function of the DC voltage value Vvr (V) output from the variable resistor 402*a*; and the stopping device 408 configured to stop upward movement of the lift plate 116*a* using the DC voltage value Vvr (V) output from the variable resistor 402*a*.

Thus, not only the remaining amount of paper sheets can be calculated through a single analog input port but also the movement of a lift plate in a paper feed cassette can be controlled on its own part. Furthermore, while the function equivalent to that of a general image forming apparatus is secured, four ports (three digital input ports and one digital output port) which would be required for the general image forming apparatus can be reduced to a single port (a single analog input port 405*a*), which enables the use of an inexpensive control circuit, such as a CPU, having a small number of ports. Therefore, further cost reduction can be achieved. Moreover, with a single port, the amount of information to be processed by the control circuit, such as a CPU, can be reduced, which reduces the burden on the control circuit. In addition, in the above embodiment of the present disclosure, the remaining amount of paper sheets can be detected in multiple steps. Therefore, the multifunction peripheral 100 can be functionally extended without changing the configuration of the multifunction peripheral 100.

Although in the above embodiment of the present disclosure the changing device 402 is configured so that as the lift plate 116*a* moves up, the resistance value Rvr (Ω) of the variable resistor 402*a* becomes lower, the changing device 402 may be otherwise configured. For example, the changing device 402 may be configured so that as the lift plate 116*a* moves up, the resistance value Rvr (Ω) of the variable resistor 402*a* becomes higher. In this case, in the table 700, the DC voltage value 701 and the remaining amount 702 of paper sheets are associated with each other so that the remaining amount 702 of paper sheets increases with increasing DC voltage value 701.

Although in the above embodiment of the present disclosure the moving device 401 is configured to move up the lift plate 116*a* when the paper feed cassette 116 is installed back into the multifunction peripheral 100, the moving device 401 may be otherwise configured. For example, the moving device 401 may be configured to move up the lift plate 116*a*, such as when the multifunction peripheral 100 starts paper feeding (image formation) or when it transitions from a sleep mode to an image forming mode.

Although in the above embodiment the present disclosure is applied to only one of the paper feed cassettes 116 of the multifunction peripheral 100, the present disclosure may be applied to all or some of the paper feed cassettes 116.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a paper feed cassette with a lift plate;

a moving device configured to move up the lift plate with an associated motor;

a changing device configured to mechanically change a resistance value of a variable resistor depending upon a position of the lift plate;

a mechanical switch configured to mechanically detect that an upper end of one or more paper sheets placed on the lift plate or an upper end of the lift plate has reached a predetermined uppermost position in the paper feed cassette;

a connecting device configured to apply a predetermined DC voltage to the variable resistor when the upper end of the one or more paper sheets placed on the lift plate or the upper end of the lift plate has reached the predetermined uppermost position in the paper feed cassette;

a calculating device configured to calculate a remaining amount of paper sheets placed on the lift plate as a function of a DC voltage value output from the variable resistor; and a stopping device configured to stop upward movement of the lift plate using the DC voltage value output from the variable resistor.

2. The image forming apparatus according to claim 1, wherein the connecting device comprises:

a first direct current source capable of applying the predetermined DC voltage; and a switch configured to make or break an electrical connection between the first direct current source and the variable resistor, and the switch is configured to break the electrical connection when the upper end has not reached the predetermined uppermost position in the paper feed cassette and make the electrical connection when the upper end has reached the predetermined uppermost position in the paper feed cassette.

3. The image forming apparatus according to claim 2, wherein the calculating device comprises:

an analog input port capable of receiving the DC voltage value output from the variable resistor; and a storage configured to store the DC voltage value output from the variable resistor and the remaining amount of paper sheets placed on the lift plate in association with each other, and the calculating device is configured to allow the analog input port to convert the DC voltage value output by the variable resistor from analog to digital and calculate the remaining amount of paper sheets associated with the DC voltage value in the storage corresponding to the converted DC voltage value.

4. The image forming apparatus according to claim 2, wherein the stopping device comprises:

a second direct current source capable of applying a higher DC voltage than the DC voltage of the first direct current source;

a comparator configured to compare the DC voltage value of the second direct current source with the DC voltage value output from the variable resistor, output a predetermined DC voltage value when the DC voltage value output from the variable resistor is 0 V, and provide no output when the DC voltage value output from the variable resistor is higher than 0 V; and a transistor configured to allow electrical continuity of the moving device with the motor upon receipt of the predetermined DC voltage value output from the comparator and forbid electrical continuity of the moving device with the motor in the absence of output from the comparator.

5. The image forming apparatus according to claim 4, wherein the transistor is electrically connected at a base terminal thereof to an output terminal of the comparator, electrically connected at a collector terminal thereof to the motor, and electrically connected at an emitter terminal thereof to a ground terminal serving as a reference potential point, and a terminal of the variable resistor opposite to the first direct current source is electrically connected, through a fixed resistor with a predetermined resistance value, to a ground terminal and configured so that when the switch is closed, the DC voltage value of the variable resistor is output to the analog input port and the comparator.

6. The image forming apparatus according to claim 1, wherein the moving device comprises:

a direct current source capable of applying a predetermined DC voltage;

a motor electrically connected to the direct current source and rotatable in a predetermined direction by application of the DC voltage;

a switch operable to make or break an electrical connection between the direct current source and the motor; and a sensor configured to detect a state where the paper feed cassette is installed in the image forming apparatus, and the switch is configured to break the electrical connection in the absence of detection of the sensor and make the electrical connection with the detection of the sensor.

* * * * *